United States Patent [19]
Schuierer
[11] 4,318,209
[45] Mar. 9, 1982

[54] APPARATUS FOR THE WET TREATMENT OF TUBULAR KNITTED TEXTILE MATERIAL

[75] Inventor: Manfred Schuierer, Michelstadt, Fed. Rep. of Germany

[73] Assignee: Bruckner Apparatebau GmbH, Erbach, Fed. Rep. of Germany

[21] Appl. No.: 141,137

[22] Filed: Apr. 16, 1980

[30] Foreign Application Priority Data

May 9, 1979 [DE] Fed. Rep. of Germany ..... 2918695

[51] Int. Cl.³ ..... D06C 3/00
[52] U.S. Cl. ..... 26/74; 26/80; 68/177
[58] Field of Search ..... 26/80, 81, 74; 57/1 UN; 68/177

[56] References Cited

U.S. PATENT DOCUMENTS

| | | | |
|---|---|---|---|
| 3,508,286 | 4/1970 | Rosen | 26/80 X |
| 3,686,905 | 8/1972 | Stanway | 68/177 X |
| 3,837,801 | 9/1974 | Schmuch | 68/177 X |
| 3,894,411 | 7/1975 | Stanway | 68/177 X |

FOREIGN PATENT DOCUMENTS

| | | | |
|---|---|---|---|
| 1460259 | 3/1970 | Fed. Rep. of Germany | 68/177 |

*Primary Examiner*—Robert Mackey
*Attorney, Agent, or Firm*—C. O. Marshall, Jr.

[57] ABSTRACT

At least one nozzle is provided for supplying a stream of air to tubular knitted textile material. A retaining device, including at least one guide roller, is provided for retaining an air bubble formed in the textile material by the air supplied thereto. Means for controlling the air supply comprises a probing device for measuring said air bubble which is separate from and is located ahead of said retaining device, and includes a feeler element in contact with the side of the air bubble which is remote from said nozzle.

8 Claims, 9 Drawing Figures

APPARATUS FOR THE WET TREATMENT OF TUBULAR KNITTED TEXTILE MATERIAL

BACKGROUND OF THE INVENTION

This invention relates to apparatus for the wet treatment of tubular knitted textile material, comprising at least one nozzle for supplying a stream of air to the textile material, and devices for retaining an air bubble formed in the material, for measuring this air bubble and for controlling the air supply.

Various devices are known for the wet treatment (such as dyeing, washing or rinsing) of tubular knitted textile material which blow air by means of nozzles onto or into the strands in order to open or spread the wet strands, which tend to cling together. Spreading the strands is necessary to facilitate the next wet treatment or drying operation. In one known apparatus of this type U.S. Pat. No. 3,508,286 to Rosen; also German Offenlegungsschrift No. 1,760,268, the air bubble formed by blowing a stream of air into the textile material is held back by two rollers of which one is fixedly arranged and the other is mounted for movement. The movable roller is deflected to a greater or lesser extent, depending on the size of the air bubble, activates a control switch and, hence, influences the stream of air blow into the textile material.

Extensive tests conducted by the applicants have shown that this known apparatus is not satisfactory in operation. Since one of the two above-mentioned rollers has to be movable to perform its function, the two rollers are not able satisfactorily to hold back the air bubble formed under all operational conditions. Instead, under a sudden insurge of air under pressure, the air bubble suddenly assumes such a size and the movable roller is thus momentarily deflected to such an extent that part of the air bubble slips through between the two rollers. To eliminate this fault, the air supply may have to be briefly switched off.

SUMMARY OF THE INVENTION

Accordingly, the object of the present invention is to obviate the above-mentioned disadvantages by constructing the apparatus in such a way that completely reliable, interruption-free operation is obtained with a simple structure.

According to the invention, this object is achieved in that the device for retaining the air bubble, which comprises at least one guide roller, is preceded by a separate probing device which contains a feeler element in contact with the air bubble on the side remote from the nozzle.

The constructional and spatial separation of the probing unit from the device retaining the air bubble is essential to the solution according to the invention, in order that both elements may be optimally adapted to their specific functions. Thus, the device for retaining the air bubble is best formed by one or two fixedly arranged guide rollers. The air bubble is safely prevented from slipping through this device, even in the event of strong surges of air under pressure and sudden significant changes in the dimensions of the air bubble.

In the apparatus according to the invention, the probing device is arranged ahead of the device retaining the air bubble. This spatial separation makes possible an optimal position of the probing device for the probing function selected. Another favourable aspect of this arrangement is that the probing device can be made relatively light because, in contrast to the prior apparatus discussed above, it is not required simultaneously to retain the air bubble.

BRIEF DESCRIPTION OF THE DRAWINGS

FIG. 4 is a cross-section similar to FIG. 3, but with the strands of textile material flat and the air supply on.

In all three embodiments, textile material 1, in particular tubular knitted textile material, is wet-treated, for example rinsed or washed, and at the same time is transported in the direction of the arrows 2. In the embodiment illustrated in FIGS. 1 and 2, at least one nozzle 3 for supplying a stream of air (arrows 4) is provided in that part of the wet treatment apparatus which is of particular interest here. Whereas FIG. 1 shows only one nozzle 3 and the parts associated therewith, several such (identical) nozzles may be provided, depending on the width of the textile material, i.e on the number of strands running alongside one another. In that case, the nozzles are arranged one behind the other perpendicularly of the plane of the drawing in FIG. 1.

The nozzle 3 is provided with an outwardly flaring mouthpiece 5 which guides the textile material 1 closely past the nozzle opening 6. As can be seen best in FIG. 2, this mouthpiece is essentially formed by two guide plates 5*a*, 5*b* which are arranged in the form of a V and which, on their inner sides, form guide surfaces for the textile material 1, diverging from the nozzle opening 6 in the direction of the stream of air issuing from the nozzle. The guide plates may be substantially flat (cf. FIG. 2) and may consist for example of sheet metal or suitable plastic plates. The mouthpiece 5 is suitably fixed to the nozzle 3 in the vicinity of its opening 6 in such a way that, in any event, the strands of textile material onto which the stream of air is to be blown are guided past the nozzle opening 6 (in the region of the narowest point of the V) between the two guide plates 5*a*, 5*b*. So far as the size of the guide plates 5*a*, 5*b* of the mouthpiece 5 is concerned, it is pointed out that, on the one hand, they should be wide enough to be able adequately to guide the textile material 1 ahead of and beyond the nozzle opening 6 while, on the other hand, they should be long enough (in the direction of the stream of air issuing from the nozzle 3) to be able laterally to guide the strands of textile material, even when they are blown open to a marked extent. Those edges of the guide plates 5*a*, 5*b* which are directed against the direction of movement of the textile material (arrow 2) are best rounded off or beaded to ensure that the textile material 1 is introduced without damage into the mouthpiece 5.

Figure 1:
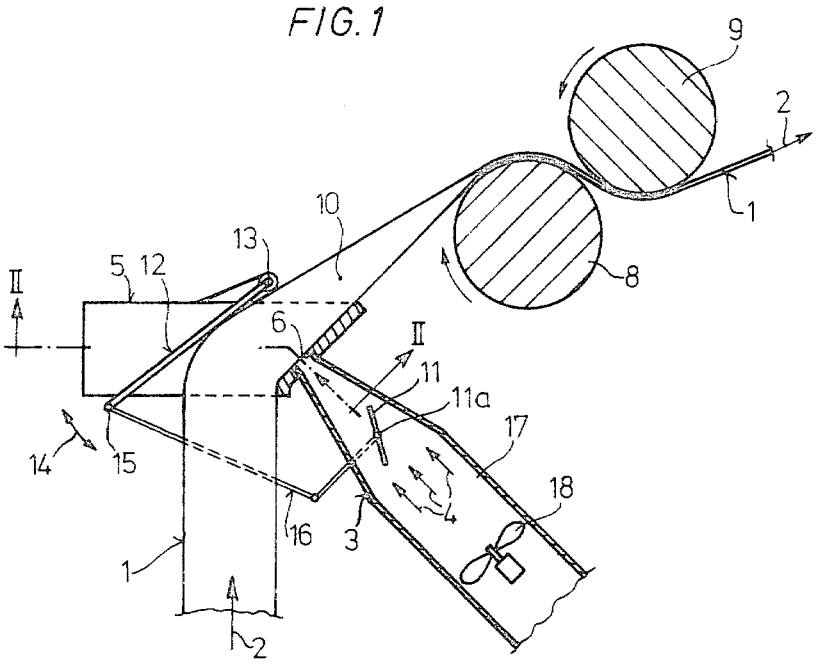
FIG. 1 is a diagrammatic partial cross-section of a first embodiment of the wet treatment apparatus in the vicinity of the air nozzle.

So far as the effectiveness of the nozzle 3 is concerned, it is also important that the textile material 1 be deflected in the vicinity of the nozzle opening 6. To this end, the nozzle 3 in the embodiment illustrated in FIG. 1 is arranged to blow obliquely upwards, while the textile material 1 is transported substantially vertically upwards (arrow 2) from an underlying wet treatment bath (not shown) in such a way that the textile material 1 is always applied under its own weight to the nozzle opening 6.

Guided in this way, the textile material 1 is further transported obliquely upwards after passing the nozzle opening 6 and the mouthpiece 5. In this connection, it is important that a device for retaining an air bubble 10 formed in the textile material be provided beyond the nozzle 3 in the direction of movement of the textile material 1. In this apparatus, the retaining device referred to is formed by two guide rollers 8, 9 which, in this case, are arranged substantially obliquely one behind the other and which are successively passed by the textile material 1 transported in the direction of the arrow 2. As can clearly be seen from FIG. 1, it is above all the guide roller 8 (the first to be passed by the textile material 1) which ensures that the textile material 1 running onto it is compressed by the first change in direction to such an extent that the air bubble 10 present in the region between this guide roller 8 and the mouthpiece 5 or nozzle 3 cannot pass beyond the guide rollers.

In many cases, for example in the treatment of tubular knit fabrics or the like, it is important to control the supply of air to the textile material 1. To this end, a throttle valve 11 acting as a control element is pivoted in the nozzle 3 where it can be moved between a fully open position and a fully closed position. In this embodiment, the throttle valve 11 is adjusted in dependence upon the angular position of a control stirrup 12 which is pivotally arranged on the side of the strands of textile material away from the nozzle opening 6, and which can be rotated by the air bubble 10 formed in the textile material 1. In the embodiment illustrated, it is assumed in the interest of simplicity that, at its end extending in the direction of travel (arrow 2) of the textile material 1, this control stirrup 12 is supported by the mouthpiece 5 via a pivot pin 13. The control stirrup 12 may then be rotated about its pivot pin 13 in the directions indicated by the double arrow 14 so that it always lies on the above-mentioned side of the textile material 1 and, in doing so, probes the size of the air bubble 10.

The control stirrup 12 is connected through a hinge 15 and a connecting rod 16 to a stem which is fixed to the throttle valve 11 at its pivot pin 11*a* (cf. FIG. 1).

This connection between the throttle valve 11 and the control stirrup 12 should provide for control in such a way that, even in the event of a minor deflection, the control stirrup 12 moves the throttle valve 11 into its closed position. At the same time, however, provision must be made to ensure that further deflection of the control stirrup 12 is possible through a free lift of the stirrup so that the stirrup 12 does not in any way interfere with the travel of the strand-form textile material 1.

So far as the supply of air is concerned, it is preferred to deliver the air from the interior of the wet treatment vessel, i.e. from the interior of the vat, to the nozzle 3. To this end, the nozzle 3 is built onto one end of an air supply pipe 17 in which a fan 18, for example in the form of an axial fan, is arranged, producing the air stream 4 to be blown onto the textile material 1.

Tests have shown that particularly favourable blowing of the strand-form textile material 1 can be obtained by designing the fan 18 to produce an air stream 4 with a pressure of approximately 2500 mm water column. In this connection, it is possible to select a nozzle in which the opening 6 has a diameter of approximately 3 mm.

Figure 2:
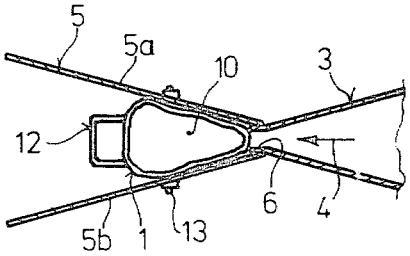
FIG. 2 is a section on the line II—II in FIG 1.

Whereas in the embodiment shown in FIGS. 1 and 2 the probing device for the air bubble comprises a control stirrup 12 which is controllingly connected to the air supply throttle valve 11 through a connecting rod 16, the probing device with the associated control elements may be differently designed, as shown by the following embodiments.

In the second embodiment, shown in FIGS. 3 to 5, the tubular knitted textile material 1 is again transported upwards in the direction of the arrows 2 and is diverted over at least one guide roller 8 in such a way that an air bubble 10 formed by blowing air into the strands of textile material is retained, as already explained with reference to the first embodiment (FIGS. 1 and 2). In this second embodiment, the separate probing device 20 comprises a feeler element in the form of a closed control stirrup 21 with which the side of the air bubble 10 and the textile material 1 remote from the air nozzle 22 is in contact. As can clearly be seen from the cross-sectional illustrations in FIGS. 3 and 4, the control stirrup 21 is supported by a tubular control element 23 with which it is fixedly connected. This tubular control element 23 surrounds an air supply pipe 24 relatively closely but rotatably, over a short section of the air supply pipe 24 (cf. FIG. 5). The control element 23 is held in its axial position by an arcuate pipe connecting element 25 surrounding it, the pipe connecting element 25 being welded onto the air supply pipe 24. The rotatability of the control element 23 in the direction of the double arrow 26 is limited by a guide slot 27 which is provided in the air supply pipe 24 and in which engages a stop pin 28 fixedly connected to the control element 23. An opening 29 in the air supply pipe 24 peripherally offset from the guide slot 27, registers with an opening 30 in the pipe connecting element 25 to which a pipe 31 leading to the nozzle 22 is connected. Another throughflow opening 32 is provided in the control element 23, being equal in size to the openings 29 and 30 and being arranged in such a way that, in one of the extreme positions of the control element 23, air is prevented from flowing from the air supply pipe 24 into the connecting pipe 31 through the openings 29, 30 (=closed position shown in FIG. 3) while, in the other extreme position of the control element 23, it is aligned with the openings 29 and 30 so that, as shown in FIG. 4, it establishes an open connection between the air supply pipe 24 and the connecting pipe 31 through the openings 29 and 30. In this way, an air control valve is obtained which controls the supply of air from the air supply pipe 24 through the connecting pipe 31 to the air nozzle 22 in dependence upon the position of the control stirrup 21 and hence in dependence upon the size of the air bubble 10 in the textile material 1. As can be seen by comparing FIGS. 3 and 4, the supply of air to the nozzle is interrupted by the control element 23 when the air bubble 10 in the textile material 1 is too large, and is completely opened when the air bubble 10 in the textile material 1 is too small or when there is hardly any air in the textile material 1. Intermediate positions may of course also be regulated in this way.

Figure 3:
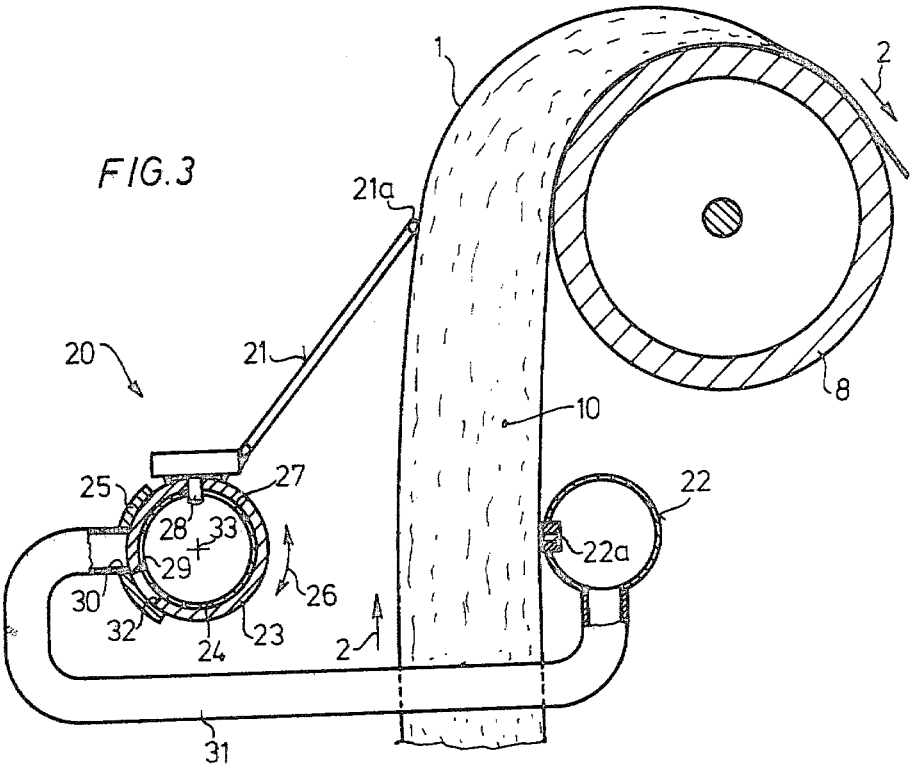
FIG. 3 is a partial cross-section of a second embodiment in the vicinity of the air nozzle, with the strands of textile material opened wide and the air supply off.
Figure 4:
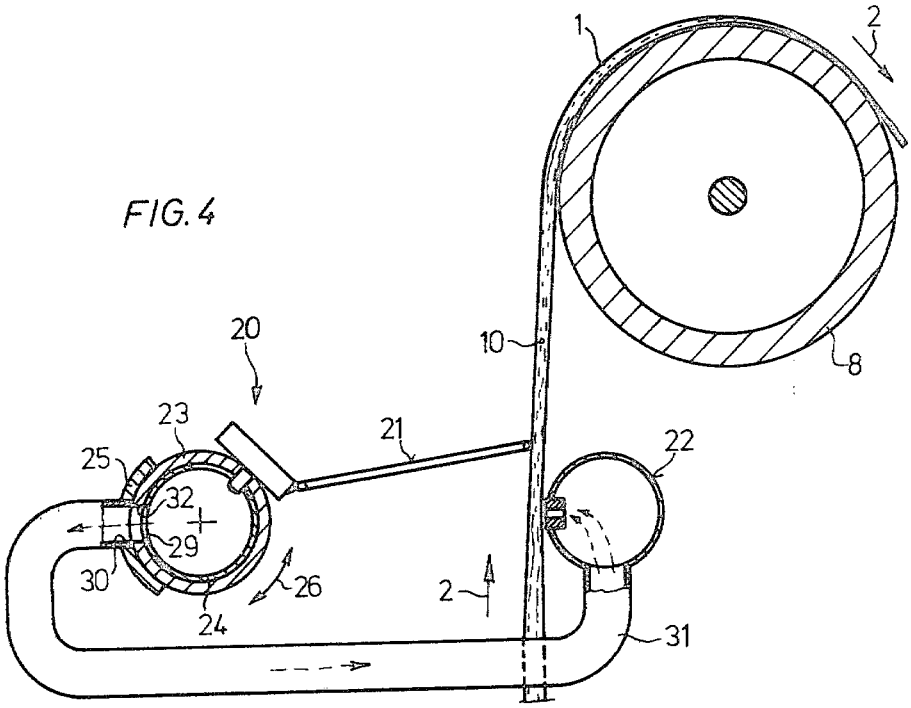
Figure 5:
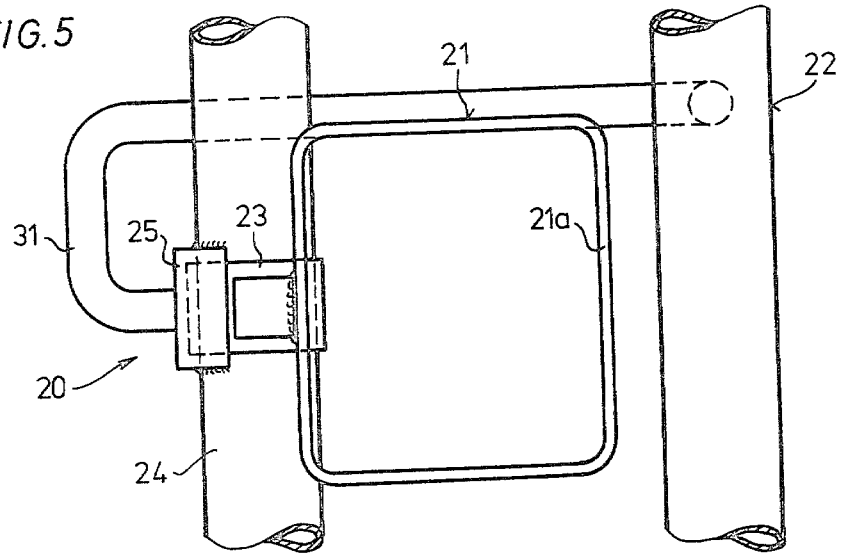
FIGS. 5 and 6 are plan views of two different air supply control systems for the second embodiment (shown in FIGS. 3 and 4).

It can also be seen from FIGS. 3 and 4 that the axis of rotation of the control stirrup 21 which, in this case, coincides with the longitudinal axis 33 of the air supply pipe 24 is situated at a lower level than the part 21*a* of the control stirrup which comes into contact with the textile material 1. The effect of this arrangement is that the control stirrup 21 rests under its own weight on the textile material 1, on the side remote from the nozzle 22. In this embodiment, the air supply pipe 24 with the control element 23 arranged thereon is also situated on the side of the textile material 1 remote from the nozzle 22. Accordingly, the connecting pipe 31 between the air supply pipe 24 and the nozzle 22 has to be arranged in such a way that it does not interfere with the movement of the strands of textile material.

So far as the nozzle 22 for delivering a stream of air to the textile material 1 is concerned, it may be provided in a header pipe which extends over the entire working width of the wet treatment apparatus, i.e. perpendicularly of the plane of the drawing in FIGS. 3 and 4, and which over its length preferably comprises a number of individual nozzle openings 22*a* (FIG. 3) or even a continuous nozzle slot.

The width of the control stirrup 21 (in the direction of the working width parallel to the nozzle header 22) is generally determined by the size or width of the textile material 1 to be treated. In the embodiment of the probing device 20 shown (in plan view) in FIG. 5, the control stirrup 21 is made narrow to accommodate relatively narrow textile material.

Figure 6:
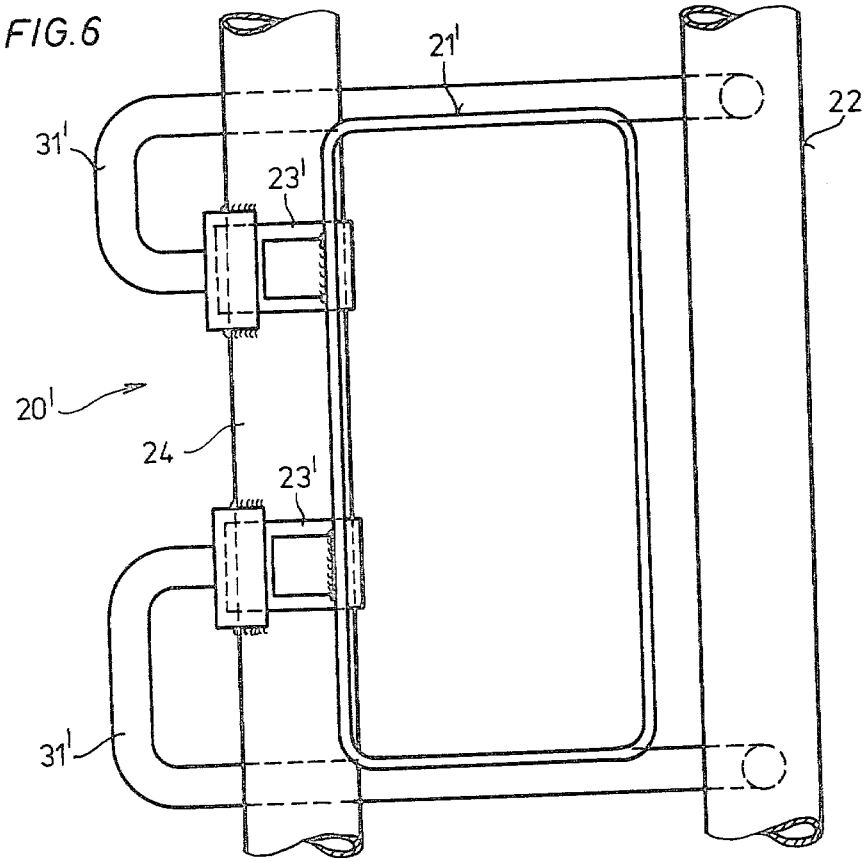

In contrast, FIG. 6 shows a probing device 20′ which is intended for relatively wide textile material. Accordingly, the control stirrup 21′ is also relatively wide and two control elements 23′ are arranged at a corresponding axial distance apart on the air supply pipe 24, each in the same way as in FIGS. 3 and 4. In this case, the control stirrup 21′ is rotatably supported by both control elements 23′ on the same air supply pipe 24. In the region of each control element 23′, a pipe 31′ is connected to the same air supply pipe 24 in the same way as in FIGS. 3 and 4, the two connecting pipes 31′ having substantially the same length between the air supply pipe 24 and the nozzle header pipe 22. These two connecting pipes 31′ are arranged on either side of the strand cross-section of the textile material.

Figure 7:
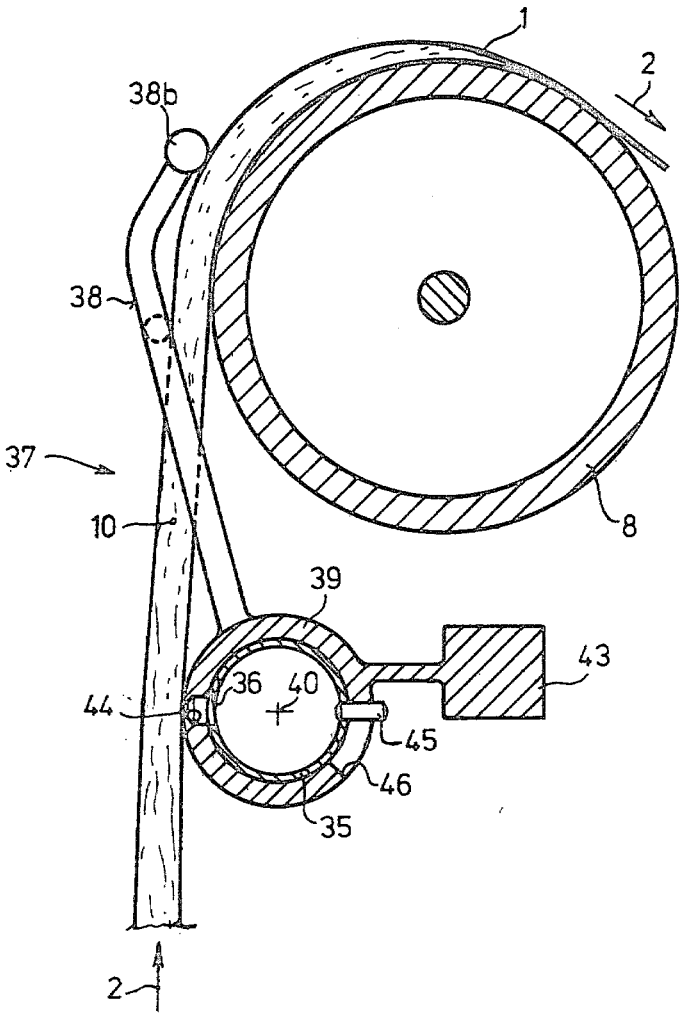
FIGS. 7 and 8 are two partial cross-sections of a third embodiment (in the vicinity of the air nozzle), on the one hand with the strands of textile material flat and the air supply on and, on the other hand, with the strands of textile material blown open and the air supply off.
Figure 8:
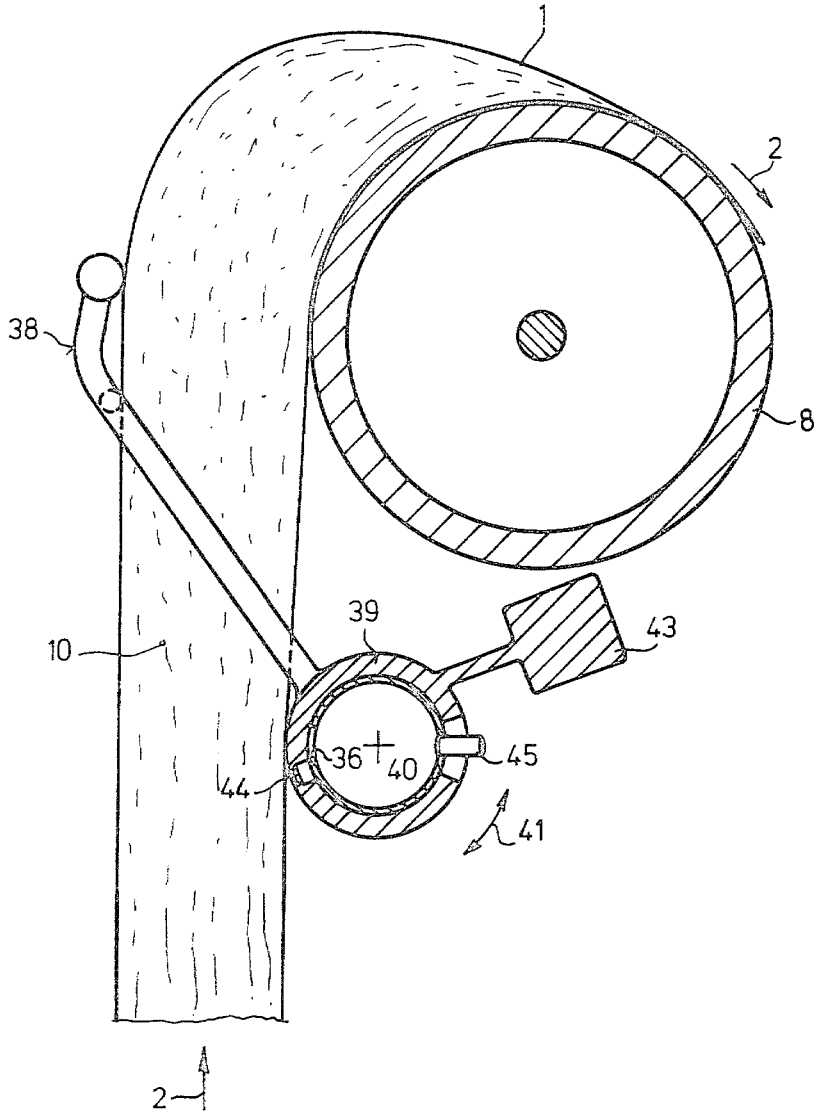
Figure 9:
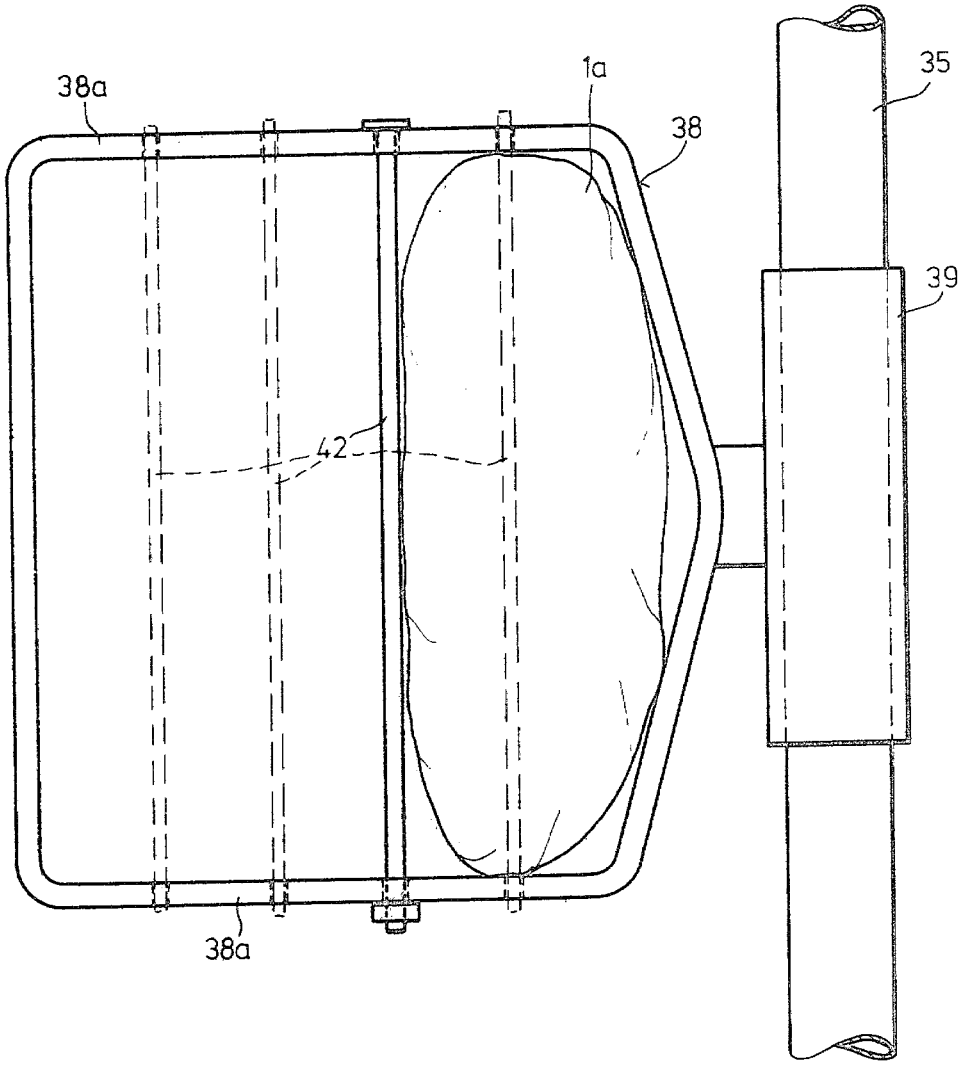
FIG. 9 is a plan view of a control stirrup probing the air bubble in the third embodiment (shown in FIGS. 7 and 8).

The third embodiment of the apparatus which is illustrated in FIGS. 7 to 9 represents a structurally particularly simple embodiment.

In the same way as in the preceding embodiments, the tubular knitted textile material 1 is initially transported upwards in the direction of the arrows 2, being guided around at least one guide roller 8 which is intended to retain an air bubble 10 formed in the textile material 1.

A nozzle pipe 35 supplying the air is arranged in the region below and—in the direction of movement (arrows 2) of the textile material 1—ahead of the guide roller 8. The nozzle pipe 35 extends substantially over the entire working width of the wet treatment apparatus (perpendicularly of the plane of the drawing in FIGS. 7 and 8) and may contain one or more throughflow openings 36 (although it may even contain at least one continuous slot).

The probing device 37 for the air bubble 10 and the textile material 1 is again separately arranged and again comprises a pivotal feeler element in the form of a control stirrup 38 which, in the same way as in the second embodiment shown in FIGS. 3 to 6, is fixedly connected to at least one control element 39 governing the supply of air to the nozzle. In this embodiment, the axis of rotation of the control stirrup 38, which coincides with the longitudinal axis 40 of the nozzle pipe 35, is arranged on the same side of the strand-form textile material 1 as the nozzle pipe 35. In contrast, that part (38*b*) of the control stirrup 38 which probes the air bubble 10 is situated on the side of the textile material which is remote from the nozzle pipe 35, and is frictionally entrained by the strand-form textile material 1. The control stirrup 38 surrounds the strand-form textile material 1 on at least three sides. As shown in FIG. 9, however, the control stirrup 38 may even be formed as a completely closed stirrup, in which case it comprises an adjustable web 42 which bounds the strand cross-section 1*a* on one side and which extends over the entire width of the control stirrup 38 and, as shown in chain lines, can be introduced in various positions (for example through opposite bores in the side members 38*a* of the control stirrup 38).

In this case, a single control element 39 is sufficient for one control stirrup 38. The control element 39 is again tubular and surrounds the nozzle pipe 35 relatively closely, although it may be rotated to a limited extent in the direction of the double arrow 41 and, at its ends, is fixed in its axial position by limiting members (not shown), in the same way as in the second embodiment shown in FIGS. 3 to 6. A counterweight 43 for the control stirrup 38 is best arranged on the control element 39 (as shown in FIGS. 7 and 8) in such a way that, in addition to being frictionally entrained by the textile material 1, the control stirrup 38 may be held against that side of the textile material remote from the nozzle pipe 35. This counterweight may even be adjustable in its force effect.

So far as the design of the control element 39 is concerned, it is pointed out that, in its peripheral region in contact with one side of the textile material 1, it comprises at least one nozzle opening 44 which may either be brought into alignment with the corresponding throughflow opening 36 in the nozzle pipe 35 or, on the other hand, may be completely displaced, depending on the angular position of the control stirrup 38 and, hence, of the control element 39 (direction of rotation as indicated by the double arrow 41). In this way, the supply of air through the nozzle pipe 35 and its throughflow openings 36 may either be released or completely shut off. Intermediate positions are of course also possible. The extreme positions of the control stirrup 38 and control element 39 may be limited by a stop pin 45 which engages in a correspondingly long guide slot 46, the stop pin 45 being secured in the fixed nozzle pipe and the guide slot 46 being arranged in the control element 39 (the reverse arrangement is of course also possible).

Quite generally, a wet treatment apparatus of the type described with reference to the various embodiments may be constructed in such a way that it is suitable for the wet treatment of a single textile strand which has been formed into an endless loop by stitching its ends together. Alternatively, it may even be designed for several endless strands of textile material running parallel to and alongside one another or even for an endless strand of textile material repeatedly guided through the treatment bath along a spiral path. In the latter case, a number of separate probing devices with nozzles corresponding to the number of strands running alongside one another may be arranged adjacent one another at corresponding intervals. In either case, the wet treatment apparatus may be used both for continuous treatment and for batch-type treatment.

I claim:

1. Apparatus for controlling accurately the degree of inflation of wet traveling tubular knitted textile material, in order to prevent excessive distention of the tubular knitted material and to maintain an intermediate degree of inflation, comprising means for transporting the tubular knitted material substantially vertically upwardly, at least one nozzle arranged to direct a stream of air against one side of the upwardly traveling tubular knitted material and thus to inflate the tubular material, a device for measuring the width of the inflated tubular material adjacent to the nozzle, said device comprising a relatively light feeler element which is generally inclined to the horizontal and rests against the upwardly traveling tubular knitted material on the side opposite to the side against which the nozzle is directed, a throttle valve which varies the flow of said stream of air and which is operated by said feeler element, said feeler element operating to prevent excessive distention of the tubular knitted material by closing said valve, and thus operating to maintain an intermediate degree of inflation, and a roller arranged to bend the tubular knitted material substantially horizontally at the top of its upward travel and thus to support the weight of the upwardly traveling tubular material and to prevent passage of the air inflating the tubular material.

2. Apparatus as claimed in claim 1 wherein the feeler element is fixedly connected to at least one control element which governs the supply of air to the nozzle.

3. Apparatus as claimed in claim 2 wherein the feeler element is pivoted upon an axis located below the part of the feeler element that comes into contact with the textile material and also is located on that side of the textile material which is remote from the nozzle, the feeler element rests under its own weight on the textile material, and the throttle valve is connected to the nozzle through an air supply pipe and at least one connecting pipe.

4. Apparatus as claimed in claim 3 wherein the feeler element is fixedly connected to two throttle valves which are spaced apart and pivotally mounted on the same air supply pipe, and which are connected to the nozzle through connecting pipes of substantially equal length arranged on either side of the textile material.

5. Apparatus as claimed in claim 2 wherein the feeler element is pivoted upon an axis located on the same side of the textile material as the nozzle, and the nozzle is located in the throttle valve.

6. Apparatus as claimed in claim 5 wherein the pivoted feeler element comprises a stirrup which is frictionally entrained by the textile material, surrounds the textile material on three sides, and comprises an adjustable web which bounds the textile material on its fourth side.

7. Apparatus as claimed in claim 1 wherein the nozzle is provided with a substantially V-shaped flaring mouthpiece which is arranged to laterally guide the textile material, and the feeler element is arranged in the flared open side of the mouthpiece.

8. Apparatus as claimed in claim 1 wherein the nozzle is provided on the end of an air supply pipe in which an axially acting fan is arranged.

* * * * *